United States Patent [19]

Bowman

[11] Patent Number: 4,969,771

[45] Date of Patent: Nov. 13, 1990

[54] MANHOLE COVER SUPPORT HAVING ENHANCED GRIP

[76] Inventor: Harold M. Bowman, 18867 N. Valley Dr., Fairview Park, Ohio 44126

[21] Appl. No.: 366,177

[22] Filed: Jun. 14, 1989

Related U.S. Application Data

[63] Continuation-in-part of Ser. No. 207,326, Jun. 15, 1988, abandoned, and a continuation-in-part of Ser. No. 201,573, Jun. 1, 1988, Pat. No. 4,867,600, and a continuation-in-part of Ser. No. 207,325, Jun. 15, 1988, abandoned, and a continuation-in-part of Ser. No. 207,266, Jun. 15, 1988, Pat. No. 4,867,601, and a continuation-in-part of Ser. No. 207,185, Jun. 15, 1988, Pat. No. 4,872,780, and a continuation-in-part of Ser. No. 323,622, Mar. 14, 1989, abandoned, which is a continuation-in-part of Ser. No. 76,668, Jul. 23, 1987, Pat. No. 4,834,574.

[51] Int. Cl.[5] ..... E02D 29/14

[52] U.S. Cl. ..... 404/26; 52/20

[58] Field of Search ..... 404/25, 26, 72; 52/19, 52/20, 21; 49/41, 466, 483; 277/207 A; 427/136

[56] References Cited

U.S. PATENT DOCUMENTS

| | | | |
|---|---|---|---|
| 1,908,909 | 5/1933 | Manz | 52/19 |
| 3,773,428 | 11/1973 | Bowman | 404/26 |
| 4,440,407 | 4/1984 | Gagas | 277/207 A X |
| 4,582,450 | 4/1986 | Neil | 404/26 |
| 4,828,274 | 5/1989 | Stannard | 404/25 X |
| 4,834,574 | 5/1989 | Bowman | 404/26 |

OTHER PUBLICATIONS

One page from Spec. No. 715-13, N.Y. State Dept. of Transportation, Albany, N.Y. entitled "715-13 Prefabricated Adjustment Rings and Frames for Drainage Units and Manholes"-published prior to 1983.

*Primary Examiner*—Jerome W. Massie, IV
*Assistant Examiner*—Matthew Smith
*Attorney, Agent, or Firm*—Watts, Hoffmann, Fisher & Heinke Co.

[57] ABSTRACT

A new manhole cover support and its processes of manufacture and use are shown. Such cover supports are used to raise the effective grade of the existing manhole cover as before road resurfacing. The cover supports are mounted upon an existing manhole cover receiving structure which has an upwardly-extending shoulder surface and a sill therebelow for accommodating such cover. The new cover support comprises basically an expandable body and a flexible, compressible synthetic or natural resin-containing retention component. The body has a seat with a lateral keeper for the manhole cover, a base with an outer wall that is reactable against said shoulder surface, and an expander for the base and seat which provides at least one gap in the base and seat. The retention component is disposed between the outer wall of the base and the shoulder surface; it interacts with expansion of the base to enhance substantially the normal frictional grip between the body and the receiving structure. It should not be less than 8-9 mils nor more than about 400-600 mils thick. Advantageously, the retention component is deposited on the outer surface of the base as a curable liquid and the resulting deposit is cured to a resident adhering mass. The receiving structure can be an existing manhole cover frame or previously-installed cover support. Some embodiments of the cover support can be adjusted as to elevation; the bodies of some are one piece and others are segmented into a plurality of connected segments.

30 Claims, 5 Drawing Sheets

MANHOLE COVER SUPPORT HAVING ENHANCED GRIP

REFERENCE TO OTHER APPLICATIONS

This patent application is a continuation-in of applicant's U.S. Patent Applications Ser. Nos. 7/207,326 of the same title abandoned; 07/201,573, filed on June 1, 1988, entitled Polygonal Manhole Cover Support U.S. Pat. No. 4,867,600; 07/207,325, filed June 15, 1988, entitled Manhole Cover Support Resistant To Water Infiltration abandoned; 07/207,185, filed June 15, 1988, entitled Manhole Cover Support With Box Flanging U.S. Pat. No. 4,872,780; 07/207,266, filed June 15, 1988, entitled Sturdy Adjustable Manhole Cover Support U.S. Pat. No. 4,867,601; 07/323,622, filed Mar. 14, 1989, entitled Support for a Manhole Cover of Standardized Diameter abandoned; and the following applications filed on June 6, 1989, entitled: Multicomponent Wales and Bases for Manhole Cover Supports Ser. No. 362,257 (pending); Manhole Cover Support With Interbraced Too Members Ser. No. 362,216 (pending); and Manhole Cover Support With Topside Flange Ser. No. 362,277 (pending). These applications were continuation-in-part applications of Ser. No. 07/076,668, filed July 23, 1987, entitled Utility Cover Extension, now U.S. Pat. No. 4,834,574 of May 30, 1989. The teachings of those applications are incorporated herein by reference.

BACKGROUND OF THE INVENTION

This invention relates to adjustable manhole cover supports for emplacing over and raising the grade of an existing manhole cover receiving structure.

For simplicity the term "existing manhole cover receiving structure" herein is used to refer to the existing, i.e., fixed in-place frame or other existing seating receptacle for a removable cover or grating that covers an access hole (i.e., hand hole, tool hole, manhole, catch basin or the like), and that cover or grating ordinarily is intended to bear vehicular traffic. The removable cover or grating itself is referred to herein as a "manhole cover." The term "manhole cover support" or simply "cover support" here means a structure that fits over the existing manhole cover receiving structure, raises its grade, and thereby accommodates a cover or grating at the new grade. Advantageously, the cover or grating is the same one that was used at the lower grade. The access hole covered is a utility enclosure serving, e.g., an electric, gas, water, sewer or storm drainage system.

Ordinarily, the instant cover support finds its use when a roadway such as a street or highway is resurfaced with a layer of paving material, typically sheet asphalt or asphalt concrete, to establish a higher grade. It then is advantageous to mount the inventive cover support atop the existing manhole receiving structure. Prior art on manhole cover supports and manhole cover frames can be found in U.S. Pat. Nos. 4,281,944, 4,236,358, 4,203,686, 3,968,600, 3,773,428, 4,302,129, 4,225,266, 4,097,171, 4,302,126, 3,891,337 and 1,987,502. The first five of these are for inventions of the applicant.

Axle loads up to 18,182 kilograms must be resisted by many of these cover supports as well as serious impact loads from vehicles and snow plows, a variety of temperature effects, steam leaks, spillage, etc., without permitting a hazardous dislocation of the cover support or its cover. Often, it is desirable also to cushion the cover a bit for resisting wear or reducing noise, or to seal the cover and its cover support against a substantial and possibly overloading infiltration of surface water, e.g., storm drainage that otherwise would enter a sanitary sewer system at various manhole locations. Adjustability of the cover support in peripheral dimension and height also is important for accommodating the wide range of specifications to be met.

Clearly, the resistance to displacement from traffic loading and impact is a paramount concern and a most general one. The supports often contain some reasonably thin (0.1 inch or less) elements such as sheet steel elements. These can include upwardly projecting cover keeper wall portions, flanging, and bases. Such thin keeper portions can be fitted into an existing manhole cover frame and, normally, still leave a large enough opening at the new grade to accommodate the same old cover or lid which was used on the existing frame. The lighter weight elements also can be effective for economy and/or ease of manufacture, handling and installation. However, a relatively low weight of the cover support, as compared to the usually thick cast iron fixture on which it is to rest, makes it a candidate for displacement in service. This is true even when a cover support can be expanded against the rising shoulder of a receiving structure such as a manhole cover frame in the manner of various prior art cover supports such as those in U.S. Pat. Nos. 4,281,944, 4,236,358, 4,097,171 and 4,302,126, noted above. Where the retention is mainly due to the weight of a cover and its support, displacement is even more of a risk.

The instant support can be made especially highly resistant to displacement and dislodgement in service without being made ponderous in weight, even when it has no mechanical fastening to the receiving structure or the manhole structure therebelow. Thus, while the present cover support can be made to incorporate conventional structural or mechanical holddown means that are integral with it or easily attached, the cover support also can do a good job of holding in (being retained in the existing receiving structure while in service) by friction alone.

Installing, adjusting, loading and unloading and otherwise handling manhole cover supports and removing manhole covers therefrom usually is done with powerful and indelicate tools such as picks, pinch bars, crowbars, tongs, heavy hooks and the like. Deformation of the cover support can occur, particularly about its upper edge which is nearest the road surface. The upper edge usually is the handiest area for applying lifting and other tools. Deformations of the edge never are good, and they can render the opening of the support unfit for service. Hence, overall ruggedness and stiffness against deformation, especially at or near the top rim, and resistance to displacement are major concerns about manhole cover supports.

On the other hand, a relatively light construction of the cover support, in comparison to the ponderous cast iron frame that usually initially supports the manhole cover when the first paving is laid, can be very desirable, provided, however, that an inordinate amount of the ruggedness, stiffness, and resistance to displacement or dislodgement is not sacrificed. Usually, a main place for weight reduction is in the lateral keeper for the cover. Another place is in the base of the cover support. Clearly the economics of manufacture, handling and installation all are generally in favor of lower weight. A relatively thin wall keeper would normally be of steel, the wall rarely being more than about 0.1 inch (12 ga.) thick, usually less.

The present adjustable support lends itself to being sealed off against water infiltration and to cushioning the cover. Furthermore, it can be made very stiff or especially durable even when employing relatively thin metal for some or all of the various body elements.

No previously proposed manhole cover supports are known by the inventor to be able to develop the retentional friction that this one can develop, let alone to include as well at least another of the additionally desirable features such as sealing off water infiltration, modest weight coupled with high stiffness and/or special durability.

BROAD STATEMENT OF THE INVENTION

The instant manhole cover support is for emplacing over and raising the effective grade of an existing manhole cover receiving structure where that structure has an upwardly-ascending shoulder surface extending from a sill that was made to accommodate a manhole cover. The new cover support has excellent retainability characteristics in service without its necessarily being ponderous and extremely heavy. It comprises:

a body; and a flexible, compressible retention component therefor, the body having a seat with a lateral keeper for the manhole cover and a base with an outer wall that is adjustable in perimeter dimension, the base being formed to face the upper part of the sill, the retention component being interposed between the outer wall of the base and the shoulder surface of the receiving structure, exhibiting a coefficient of static friction with respect to said wall and shoulder surfaces that substantially exceeds the coefficient of static friction obtainable directly between said surfaces, and being disposed to interact with the expansion of the base for enhancing substantially the grip between the body and the existing receiving structure.

BRIEF DESCRIPTION OF THE DRAWINGS

FIG. 1 is a top plan view of a preferred nominally 36-inch diameter split-ring embodiment of the instant cover support adapted to fit a circular manhole and having a bonded-on retention component;

FIG. 2 is a vertical cross section of FIG. 1 taken through Section 2—2;

FIG. 3 is a vertical cross section of FIG. 1 taken through Section 3—3;

FIG. 4 is a side elevation view of the cover support of FIG. 1;

FIG. 5 is a top plan view of a preferred four-segmented embodiment of the instant cover support with the four joints bridged by rods. It is otherwise like the single-jointed split ring embodiment of FIG. 1, and it is capable of more adjustment in perimeter and development of a greater frictional grip than its split-ring counterpart;

BEST MODES FOR CARRYING OUT THE INVENTION

Figure 1:
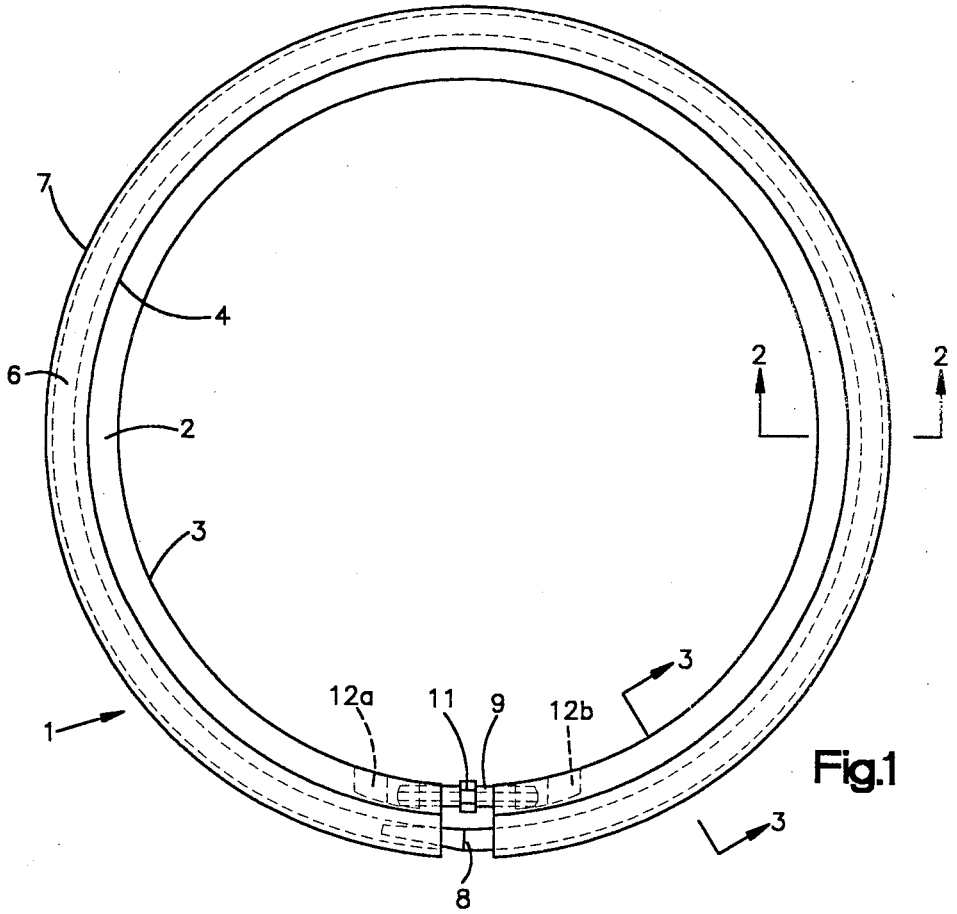
FIGS. 1—5 illustrate adjustable cover supports with practically vertically rising cover keeper walls. Such keepers necessarily must be thin-walled to fit into an existing frame and still accommodate the original cover. In other words, that cover must lie flat on the new seat that is bounded by the walls of such keeper.

Reference is made to FIG. 1. The cover support broadly is indicated by arrow 1. Seat 2 for the cover is the top of the cast ductile iron (ASTM type 536, grade 60-45-12) base of this cover support. Its inner vertical wall is one inch in height, item 3. Welded to and rising up from the outside top edge of the base is a lateral keeper 4 for the cover. The keeper of 13 ga. (0.09395″) steel. The top 6 of the keeper is formed into a hollow ($\frac{3}{4}\times\frac{3}{4}$″ inside dimensions) wale having outside wall 7.

The base and keeper, including the wale, form an almost complete circular pattern which is interrupted only by a joint that is connected with a turnbuckle bolt 9 and is bridged with tapered steel shaft 8.

The right end of the shaft is of essentially square cross section, and it makes a snug fit into, and is welded into, the hollow channel part of the wale. The left end of the shaft 8 is somewhat tapered, and it makes a slidable fit into the other end of the hollow channel part of the wale. Thus, the entire wale can be considered to be the box flanging around the upper periphery of the keeper and the shaft 8 across the joint.

The ends of the turnbuckle bolt 9 are threaded with opposite handedness to open up the gap of the joint when turned one way, and to shorten the gap when turned the other way with a wrench acting on wrench grip 11. For security in service, a nylon locking patch is applied to the bolt threads. The bolt 9 is of A.I.S.I grade 302 stainless steel; each end of it runs into a horizontal hole in the base. The holes are tapped appropriately for bolt adjustment and extend to reach the notches 12*a* and 12*b*. The notches accept the protruding ends of bolt 9 when the gap is shortened.

If a greater amount of peripheral adjustment and greater frictional grip of the base into a manhole frame or the like is desired, a pair or two pairs (or more) of diametrically opposed joints of the type connected by bolt 9 can be used in the cover support. Thus, the cover support will be made of two or four (or more) segments, usually of equal size, if the cover is circular. However, if the cover support is rectangular or otherwise polygonal or oval in plan, the joints can be at corners or on the sides; the resulting connected segments, while usually making a generally symmetrical whole in plan, will not necessarily be of equal size.

Figure 2:
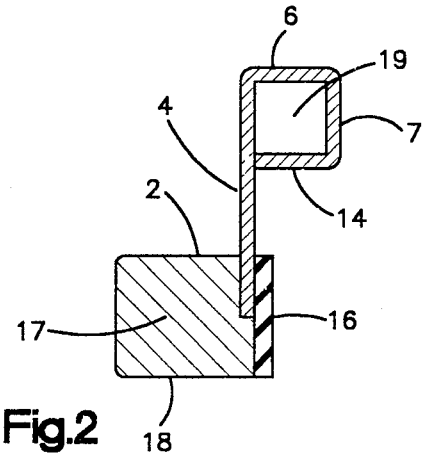

The elements of the cross section shown in FIG. 2 include those with the same numbers as used in FIG. 1 plus these: 17, the cast ductile iron base; 19, the hollow channel of the wale; 14, the bottom of the wale which can be tack-welded along the outside of keeper 4; seat 2 for the cover; bottom 18 of the base which is to rest on the existing manhole cover receiving element; and a frictional retention member 16 which is about an eighth inch thick of slightly foamed elastomer bonded to the base all around its outer perimeter. Sheet steel keeper 4 is welded to base 17 and any lumps, spatter, etc. are removed, e.g., ground off the outer and inner seams that it makes with the base.

Figure 3:
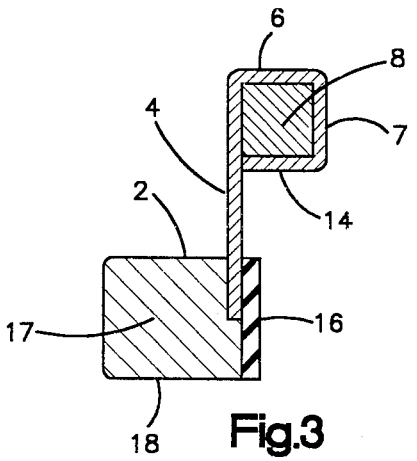

The elements of FIG. 3 are the same as those of FIG. 2 except that the wale at this zone includes shaft 8 as an integral (e.g., welded-in) part.

Figure 4:
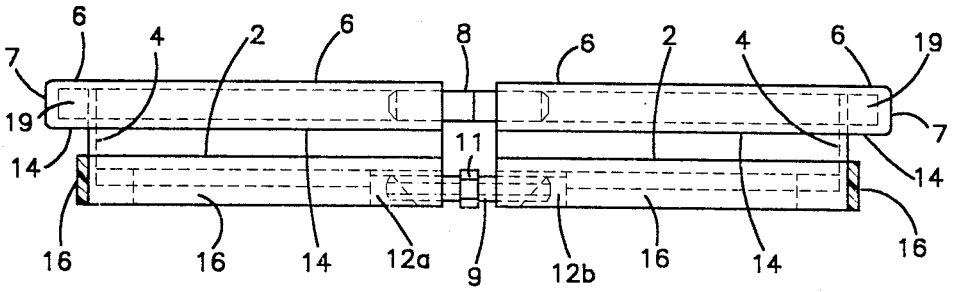

The elements of FIG. 4 that also are shown in FIGS. 1, 2 and 3 have the same numbers as in those figures. Thus, item 16 is the retention component, 8 the shaft and 19 the hollow channel of the wale, 9 the turnbuckle bolt, 17 the wrench grip of the bolt, and 12*a* and 12*b* the left and right notches, respectively, for permitting protrusion thereinto of the bolt ends. Optionally, if the retention component is not expected also to help seal out water as at least part of a seal element, can be made in the form of a plurality of incomplete lines, stripes or spots bonded to the surface instead of being in a sheet or film conformation. If desired also, the retention component can be a separate strip or strips of flexible, compressible polymer interposed between the base and the existing manhole cover receiving structure instead of such polymer being bonded on. Furthermore, it can be in the form of one or more bands or O-rings surrounding and even elastically gripping the base, e.g., in grooves therein.

The cover support embodiment shown in FIGS. 1, 2, 3 and 4 has a good frictional grip to an existing manhole cover frame. This is because the coefficient of static friction between the surface of many conventional deformable synthetic and/or natural resin-containing materials (typically containing polymeric substances and including many foamed elastomers), and metal surfaces can be much greater than that between two metal surfaces. Thus, the coefficient of static friction for the contact of a desirable frictional retention component to a metal should be at least about 0.4, and generally it can be as high as 0.6–0.7 or even higher. In a steel-to-steel instance, it is unlikely to be as high as 0.35. Shore A Durometer hardness of the retention composition preferably is at least about 20, and preferably it is about 50–70. The minimum thickness of a retention component should be no less than slightly above 8 mils, and preferably such minimum is about 20–25 mils; the maximum should be no more than 500–600 mils, and a 400 mils maximum is preferred. A thickness between about 20 and about 400 mils is generally quite practical, and about a 1/16 to about an ⅛ inch is most highly preferred. Oil resistance can be desirable for it and the other water-sealing elements in some installations.

The coefficient of static friction is the ratio of the maximum force parallel to the surface of contact which acts to prevent motion between two bodies at rest in contact with each other from sliding over each other, to the force normal to the surface of contact which presses the bodies together. Thus, the turnbuckle or other conventional spreader means, usually screwed types, at the joints supply a large measure of pressure, and the bonded elastomer heightens friction, thereby making a cover support that is unusually effective for resisting dislodgement or tilting in highway service. Means for locking down the cover support to an existing manhole cover flange, e.g., like the means shown in U.S. Pat. No. 3,773,428, often are desirable in addition to simply a frictional grip.

Figure 5:
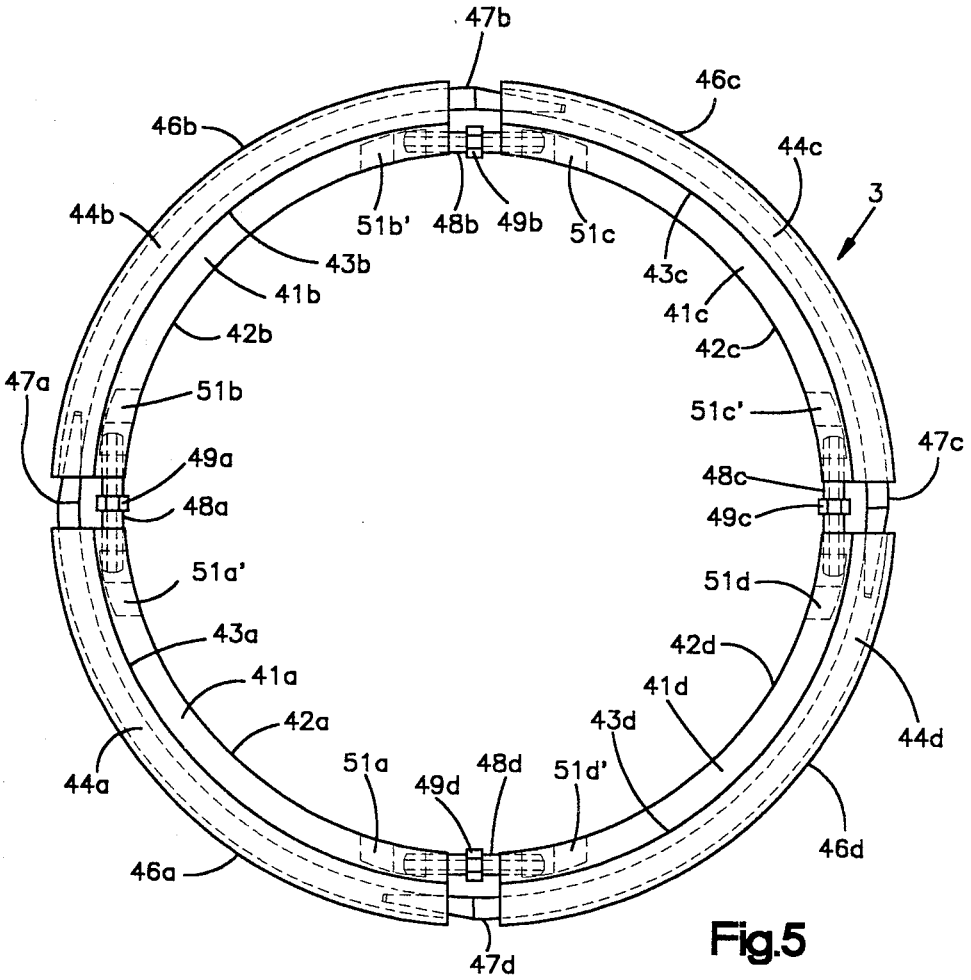

In FIG. 5 the ferrous metal body of a manhole cover support is in four like segments and is referred to broadly by arrow 3. Its body differs from that of FIG. 1 mainly in that respect, the body of the cover support of FIG. 1 being a split ring. The multi-segmented cover support of FIG. 5 is capable of greater adjustment and a much greater frictional grip to the shoulder of an existing manhole frame than is a corresponding split ring cover support. However, retention component portions are applied to the outside of the base portions of each segment shown in FIG. 5 in the same way as that component was bonded to the outer wall of the base of the embodiment earlier illustrated in FIGS. 1, 2, 3 and 4.

In FIG. 5, the seat portions of the base are 41*a, b, c* and *d*: inner wall portions of the cast ductile iron base are 42*a, b, c* and *d*: the rising 13 gauge steel keeper portions are 43*a, b, c* and *d*; the outer wall of the base and the lower part of the steel keeper are coated with bonded-on elastomer like that shown in FIGS. 2, 3 and 4; the turnbuckle bolts are 48*a, b, c* and *d*; their wrench grips are 49*a, b, c* and *d*; the top of the keeper portion is a box flange portion having top portions 44*a, b, c* and *d* and side portions 46*a, b, c* and *d*; shafts 47*a, b, c* and *d* connect the channels of the opposing box flange portion ends and bridge the four joint gaps; and notches 51*a, a', b, b', c, c', d* and *d'* are disposed to permit protrusion thereinto of the ends of bolts 48*a, b, c* and *d*. The tapered ends of the shafts fit slidably into the channel portions of the box flange portions; their other ends are welded into the channel portions. Because of the remaining similarities between the metal bodies of FIGS. 1 and 5, additional views of the embodiment of FIG. 5 are believed unnecessary to understand the embodiment clearly.

Figure 6:
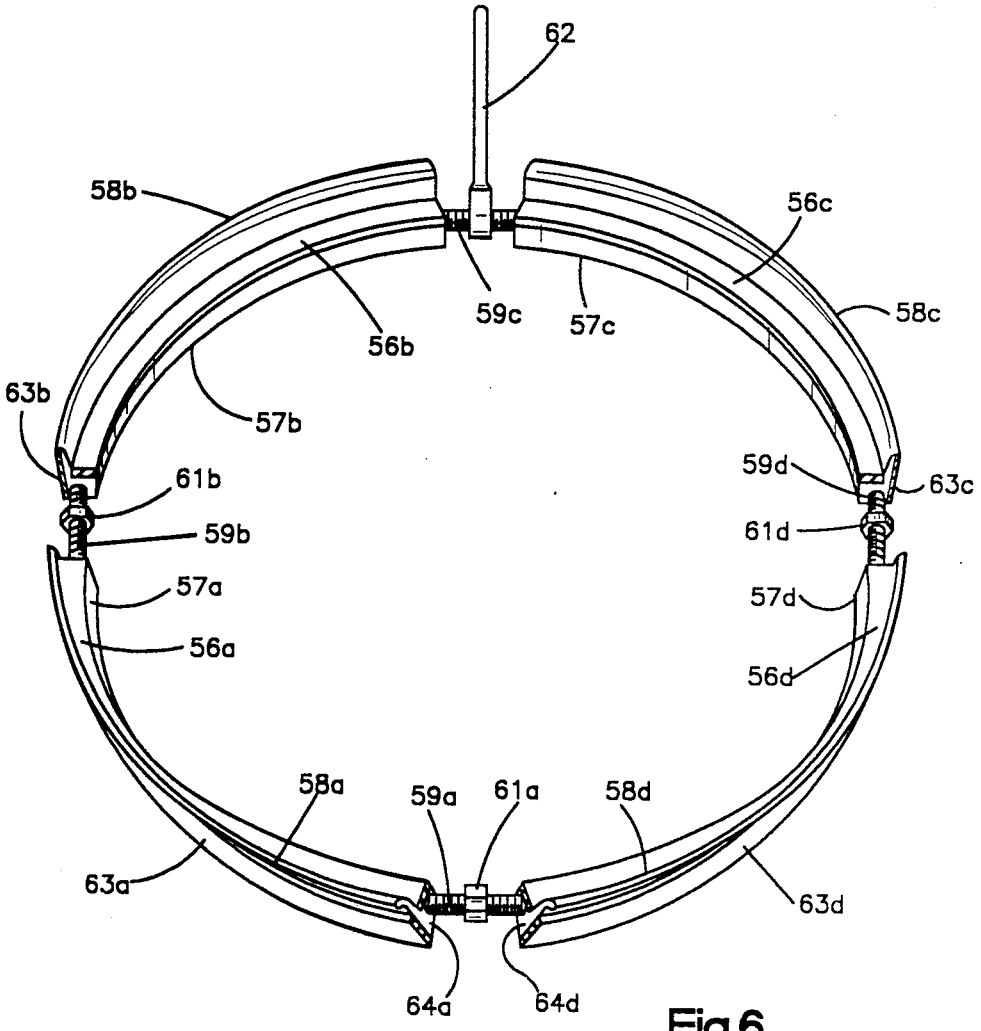
FIG. 6 shows a simplified perspective view of a four-segmented cover support being adjusted in exterior diameter preparatory to installation on a manhole cover frame. The cover support differs from that of FIGS. 1, 2, 3, 4 and 5 by having only very short outward flange portions at the top of the keeper portions and no connections therebetween.

The simplified perspective view of FIG. 6 shows a preferred four-segment cover support with an open-ended box wrench 62 fitted on the most distant wrench grip of a turnbuckle bolt, a grip that otherwise would be seen and numbered as 61*c*. Clockwise turns reduce the outside diameter of the assembled segments when one is preparing to slide the new cover support into an existing manhole frame. The other such adjusting bolts shown are bolts 59*a, b* and *d* with their respective wrench grips 61*a, c* and *d*. The bolts are of A.I.S.I. 302 stainless steel.

The top of the base portion of each segment has deformable polymer seat portions, 56*a, b, c* and *d*, each about ¼ inch thick, bonded thereto to cushion the cover. The seat portions also act as part of the water seal under the manhole cover. The bottoms 57*a, b, c* and *d* of the base portions will rest on the sill of an existing manhole frame when the cover support is installed.

The outside wall portions of the base portions, and the lower parts of keeper portions, terminating in slight outward flanges or lips 58*a, b, c* and *d*, are coated with about ⅛ inch thick bonded-on polymer layers, 63*a, b, c* and *d*, like that making the cover seat, specifically a tough, heat-cured slightly foamed, elastomeric vinyl plastisol. These coatings act to grip the shoulder of the existing manhole frame as well as to form part of the water seal around the new cover support.

The gaps between base portion ends such as those marked "64*a*" and "64*d*" (corresponding ones at the end of each segment are not marked to avoid clutter) can be sealed or plugged as will be taught hereinafter to resist infiltration of much surface water.

The bolts joining the segments, and all other threaded bolts and screws in the cover support, have nylon locking patches on their threads for security in service. Conventional hold-down means such as screwed-on clamps running from the base down and under the sill of the existing manhole frame are not shown; they can be included when desired or needed. They are shown in my co-pending parent application entitled Polygonal Manhole Cover Support filed on June 2, 1988 U.S. Pat. No. 4,867,600, referred to above.

Figure 7:
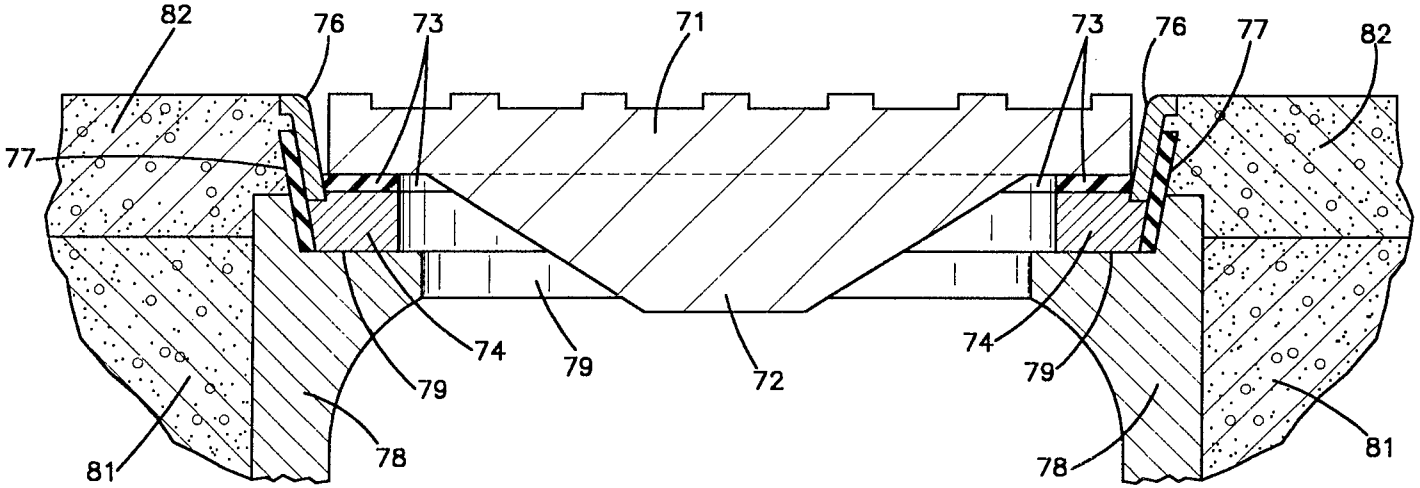
FIG. 7 shows in vertical cross section the installation of an embodiment of the cover support like that of FIG. 6 in a roadway. The section is taken on a vertical plane through the middles of diametrically opposite segments of the four-segment cover support.

In FIG. 7 new paving layer 82 of asphalt concrete surrounds the upper part of the installed manhole cover support, while the outside of the existing manhole frame 78 is surrounded by the original portland cement concrete paving 81. Resilient polymer cushion-seal 73 lies under manhole cover 71 and is bonded to the top of cast iron cover support base 74. Welded onto and rising from the base is 13 ga. steel keeper 76. Resilient polymer gripper-seal 77 is bonded to the outside wall of the base and the lower part of the keeper.

The cover support rests on the sill 79 of cast iron manhole frame 78. The bottom of the cast iron cover 71 is reenforced with integral bracing 72 that projects down into the manhole. The sealing at the joints will be taught hereinafter.

Figure 8:
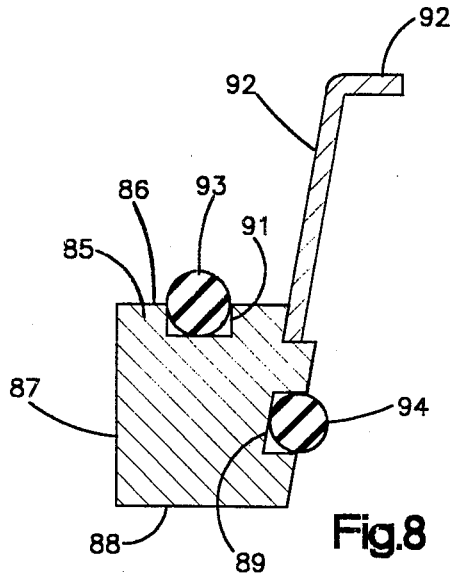
FIG. 8 shows a vertical cross section of an alternative cover support fitted with an elastomeric O-ring stretched around the outer periphery of its manhole cover supporting base and another resting in a notch on the top of the base. The section is taken in a vertical plane through the middle of the pair of 180° segments making a two-segment circular cover support.

In FIG. 8, both parts of the cast iron base 85 have an inner wall 87, a bottom 88, a top 86, and two grooves running for their full lengths. The welded-on strip steel keepers 92 have outward flanging 92 at their tops. Residing in groove 91 is an O-ring 93 to seal and cushion a cover. To seal most of the outer wall of the base and provide extra friction with the rising shoulder of an existing manhole cover receiving structure is an O-ring 94 fitting into groove 89 that runs around the outside of the base. Joint sealing will be dealt with later. The O-rings are not bonded to the metal.

Figure 9:
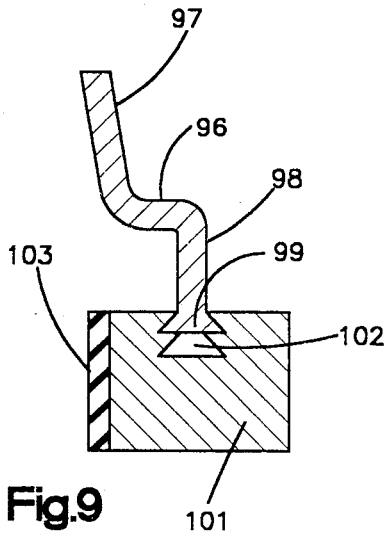
FIG. 9 shows a vertical cross section of a cast ductile iron-bodied circular cover support. The section is taken in a vertical plane through the middles of diametrically opposed segments of a four-segment circular cover support.

In FIG. 9, the cast ductile iron, type 60-45-12, segment has base 101 has bonded-on deformable polymeric retention component 103 and a pair of cavities, the presently empty lower one being denoted as 102. Projecting up from seat 96 is keeper 97. Projecting down from seat 96 is skirt 98 terminating in an enlarged lower rim 99. The rim can fit slidably into each of the cavities of the base. The cavities and rim have a trapezoidal cross section, and either cavity can support the upper seat portion of a segment for adjusting the seat elevation. More than two such cavities can be superimposed in the stack of them for greater adjustment, as is shown in Applicant's U.S. Pat. No. 4,281,944.

Figure 10:
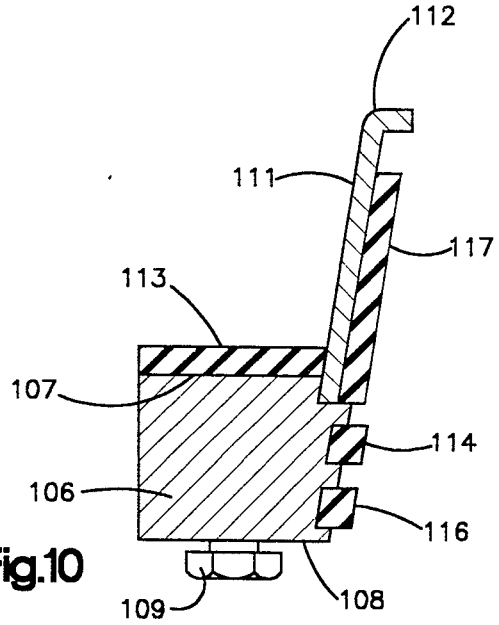
FIG. 10 shows a vertical cross section of a circular cover support fitted with an elevating screw, several elastomeric band-like retention components stretched around it and with an elastomeric seat for the cover. The retention components and the seat need not be bonded to the metal body of the cover support, but that is preferable. The section is taken through the middle of a split ring cover support opposite the adjustable joint.

In FIG. 10, cast ductile iron base 106 has top 107, bottom 108, and a 302 stainless steel elevating screw 109 tapped into the base. The screw is one of thirty. Projecting up from the base is welded-on strip steel keeper 111 terminating in flange 112. Around the outer perimeter of the base are thick narrow bands of deformable polymer 114 and 116, fitting into peripheral grooves in the base, and a wider band of like material running around the outside of the keeper. The bottom of the wider band fits into the slight peripheral edge that the keeper makes with the base. On the top of the base is bonded seal-cushion element 113 of a tough, flexible water-resistant ionomer. The ionomer is bonded to the base. The other polymeric materials are not bonded, although some or all of them can be so bonded, e.g., directly to the metal that has been cleaned and usually treated for bonding, or with the use of a permanent or even a temporary adhesive.

Suitable synthetic or natural resinous materials that can be formulated into compositions for use in the compressible retention component and water seals herein include rubber and plastic materials such as natural and synthetic rubbers, water-resistant ionomers, various vinyl polymers and copolymers such as polyvinyl acetate-polyethylene-acrylate copolymers and polyvinyl chloride homopolymers, polyurethanes, polyester resins, epoxy resins, styrene-containing copolymers such as ABS and butadiene-or isoprene-styrene copolymers, rosin and rosin derivatives, thick tars and pitches, polyolefins and copolymers containing olefin units, and aminoplasts. Plasticizers, pigmentation, stains and/or mineral fillers such as talc, carbon black, etc. commonly are employed in their recipes. Cork particles bonded with such resin material as a binder can be useful, also. The preferred retention components, in addition to being deformable, appear to be elastomeric. Many of them can be foamed and preferably are foamed only very slightly; this can soften them a bit, and it makes them slightly less dense than without the foaming. Latent foaming agents, reactive upon warming and/or catalyzing, and incorporated in a film of an uncured polymer-providing material coated on a cover support are preferred. Curing with heat, ultraviolet or electron beam radiation and/or catalysis can be practiced.

Customarily, it is of advantage to prime a metal with a bonding agent or use a bonding treatment to secure the best bond of most retention components or a water sealing element to metal. Some polymers can bond well without this, e.g., epoxy resins. However, the bonds of most are improved by such priming and/or treating.

A preferred foamed plastisol formulation for the retention component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyolpolyurethane foam, slightly elastomeric and rubbery. Some polymer recipes need heat to cure and foam, even with catalysis, and others cure and even foam at about room temperature (78° F.). The degree of foaming in both these plastisol and urethane formulations is very small, and it could be called almost microscopic and slight—the bubbles are closed-cell and tiny. In some cases, especially where sealing is to be maximized and strength considerations are secondary, a fair amount of foaming and a resulting softened and less dense foamy structure can be tolerated, e.g., Shore A Durometer hardness of 20–55.

A recipe for a slightly-foamed polyurethane rubber that has been found to be quite effective here is as follows:

- 100 weight parts of Adiprene #L167 polyurethane, a product of the Uniroyal component of the F.G. Goodrich Company, Naugatuck, Conn.
- Compounded with these additives: 0.3 weight part of water;
- 0.3 weight part of Dabco-33LV, a product of Air Products, Inc., Allentown, Pa.;
- 1.4 weight parts of DC-193, a product of Dow-Corning Inc., Midland, Mich.; and
- 16.0 weight parts of "BC", a product of Palmer, Sieka Inc., Port Washington, N.Y..

This material can be applied to warmed, cleansed and bonding agent-treated cast iron and steel, then heated to 250°–350° F. to develop the foam and full cure of the polymeric material.

Some preferred heat-curable plastisol recipes for various Durometer hardness contain 100 parts of low molecular weight polyvinyl chloride resin plasticized with 60–70 parts of a conventional phthalate plasticizer such as dioctyl or dimethyl phthalate. With this a conventional stabilizer, 1–3 weight parts, for PVC, e.g., a lead-based stabilizer, is used along with 1–2 weight parts of a red colorant (other pigments and colors, or none, can be used, if desired), and 0.5–3 weight parts of an ozodicarbonamide heat-and water-activated blowing agent.

A preferred foamed plastisol usually is sprayed on the area to be coated. It is advantageous to spray it onto the hot metal cover support body (370°–380° F.) and let it cure and foam a bit. If extra foaming and/or curing is desired, the coated part can be further warmed at 380°–400° F. for up to a few minutes.

The deformable retention component should be at least about a half mil thick for most effective gripping to contact surfaces (which normally have irregularities); rarely should it be more than about 400 mils thick for economy and durability, although thicker retention components (or even portions of same) can be especially useful for sealing on some occasions. The same applies to cushioning components for cover seats, although these usually are at least about 50 mils thick and easily can be as thick as 500 mils or more.

Metal surfaces should be cleaned to accept the polymeric material, if it is to be bonded thereto. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the body and various elements of the body, are of a ferrous metal, e.g., steel and/or cast iron, particularly cast ductile iron. Other metals can be used where their special properties are desirable and their cost can be tolerated), e.g., stainless steel, high tensile strength steel, wrought iron, bronze, brass, etc. Also, suitable in some cases cover support parts can be, and even much of the main body structure can be fabricated from glass fiber-, aramid fiber-, or graphite fiber-reenforced resin, e.g., a thermosetting resin such as a polyester or epoxy resin. Also highly filled polymers including elastomers, or ABS plastic and the like, i.e., tough structural polymeric materials can be used in the invention. In some instances, it is possible to fit an expansible metal shape, e.g., a steel ring, to the inside part of a manhole cover support body. This body is otherwise almost entirely a tough, flexible polymeric material, optionally pigmented with, e.g., carbon black, and optionally built up in plies with glass, nylon, cotton and/or steel cloth and/or cords (like a truck tire carcass). In some such instances, the outer part of the body can act as the retention component, although softer polymer-containing films often can be used with advantage as special retention components over the cover support body.

Reference is made again to FIGS. 2, 3 and 4 which display a split-ring cover support with an about $\frac{1}{8}$ inch thick bonded polymer retention component 16, and to FIG. 6 which shows a four-segmented circular manhole cover support. In tests on related nominally 23-inch circular four-segmented manhole cover supports much like the one in FIG. 6, also joined with turnbuckle bolts and having the same kind of adhering foamed elastomer retention component (actually a heat-cured vinyl plastisol retention component) the following significant fact was revealed: pulling directly upward on an expansible cover support that was held in a ring of steel by only the friction between its elastomer-coated periphery and the ring and its own weight (which was only an inconsequential minute percentage of the whole load to be pulled) took much more force (3250 pounds) to remove than a like cover support held the same way in the ring with the same hoop stress exerted, but having no such retention member interposed. The force factor was about 1.38 times as much for the coated support as for the uncoated one.

This series of tests also showed that the force factor for the four-segmented, 23-inch diameter cover support with the polymeric retention component was 1.41 times that of its split-ring counterpart, the split ring also having the same sort of retention component. Further, it was found that the force factor for that so-coated split-ring counterpart was roughly double that of a like steel split-ring cover support that had no such polymer retention component at all. Additionally, the tests indicated that the strain distribution around the four-segmented cover support was far more even than that around the split-ring cover support. In a further test a nominally 24 inch diameter four-segment cover support, like that of FIG. 6 and having the preferred cured plastisol retention component, required 4750 pounds of vertical pull to pull it out of the steel test ring.

This testing of an expandable, nominally 23-inch (outside diameter) split ring 1 inch high by $\frac{3}{4}$ inch thick and equipped with strain gauges, the ring being held in a manhole frame, further indicated that there was appreciable nonuniform bending in the ring as the gap therein was widened only slightly to force the ring strongly against the frame.

Accordingly, a finite element analysis of a 1 inch by 1 inch split ring ($23\frac{1}{4}$ inches in outside diameter) held in a 1 inch by 1 inch cast iron frame (having a $23\frac{3}{4}$ inch internal diameter) was undertaken by computer. The material properties listed below were used, the force was reckoned in increasing finite increments, and the materials were assumed to be elastic with large deformations.

| Component | Young's Modulus | Poisson's Ratio |
|---|---|---|
| Frame (cast iron) | $2.9 \times 10^7$ psi | 0.3 |

-continued

| Component | Young's Modulus | Poisson's Ratio |
|---|---|---|
| Split Ring (steel) | $2.9 \times 10^7$ psi | 0.3 |

At expansion forces of 2400 to 3000 pounds localized ring-to-frame contact was found. This was consistent with the previous ring-with-strain-gauge tests. From the previous tests about 3000 pounds appeared to be a high practical loading for a ring equipped with a ½-inch diameter threaded bolt for expansion. At the 3000 pound force the gaps between the ring and the frame (calling for fill, e.g. with a frictional retention component, to complete the compressive contact between ring and frame) ranged from 8 to 19 mils with an average of 11 mils. Based on this analysis the thickness of a frictional retention component would need to be at least 11 mils thick for the fill. In order to have about 75% of the gaps filled 8¼ mils would be required. To put this into perspective, architectural paint coatings and primers for steel work on bridges normally are about 1½ to 2 mils thick; the usual heavy industrial and maintenance protective paint coatings can reach about 3 mils, and occasionally they approach 5. Paint films in general are expected to be less than 4 mils thick; thicker than that, the films usually are termed "coatings" rather than "paints". They often are referred to as coatings of a special type, e.g. coal tar epoxy finishes of 10 mils, and some other speciality coatings that can be even thicker.

In connection with the present invention, however, the frictional retention component is likely to be marginal at best when such component is below 8–9 mils. One must expect, also, asperities and irregularities in surface and shape of the cover supports and frames as well as wear, customary size variations in frames of the same nominal sizes, the variability of the outward flare in the keeper walls of the frame, the fact that an expanding ring of a support, even a multisegmented one with the superior gripping property as compared to a split ring, deviates more and more from a true circle as it is expanded (and maximum expansion must be expected in at least some few cases in any installation), etc. Plus or minus an ⅛ inch per foot is the customary tolerance for cast iron in this service. Hence, at least about 20–25 mils is a preferable lower limit for thickness of the retention component while 8–9 mils is the extreme lower limit, and 11–20 mils is a bit more comfortable lower limit in the typical service situation.

On the other hand a thickness of as much as about 500–600 mils for such component often can be tolerated in some cases, but beyond that this deformable, compressible component is likely to be the main if not all of the material in contact with the seat or sill of the manhole cover frame and this can be undesirable. Furthermore, especially where the keeper wall of the new cover support being emplaced approaches being vertical, the original manhole cover is unlikely to fit the new support. Accordingly about 400 mils thickness is a preferred upper limit for the frictional retention component.

For efficiency and economy and the broadest application to general service situations, a thickness of the component approximately about 1/16 to an ⅛ inch thickness (e.g. about, 60–130 mils) is the most highly preferred. Clearances of about an ⅛ of an inch is generally all that can be counted on consistently for existing covers. As such retention components are new to the field of manhole cover supports, the foregoing critically of their thicknesses appears not to have been considered by practitioners of the art heretofore.

If the adjustable joints of such cover support are plugged with deformable polymer (e.g., elastomer like that discussed above in connection with retention components and seats, and especially foamed elastomer, so that complete water seals result under the manhole cover 81 and all around either the outer perimeter of the cover support base or its cover keeper rising there around, or both) then the cover support can be used to resist stray surface water such as storm drainage.

Suitable sealing plug figments to be used with the cover support as it is being installed can be made of polymer or with a core or armature, e.g., one of metal, coated with polymer. Alternatively, the plug can be effected after the cover support is installed by stuffing in or spraying in a flexible sealant, preferably a foaming or foamable-in-place one.

Hollow, peripheral encircling wales (rim) portions and hollow base portions can be filled or partly filled with a hard or tough resin, optionally mixed with a mineral filler such as mica or chopped glass fiber strand, to supply desirable further resistance to crushing and other deformation. Thermosetting resins such as polyester and epoxy resins can be useful in this connection. Also, thermoplastic ones such as ABS resin can be so used, or even a concrete such as a Gunnite type.

The cross section of the sleeves and wales and bases may be other than squarish or rectangular. They can be made with many other fairly rigid conformations, e.g., triangular, rounded, etc. The same applies to the cross section of solid or tubular wale-forming and base-forming members and joint-bridging rod or tube elements. While only solid bases have been illustrated, it should be clear that they can be made hollow, e.g., like the main part of the wale of FIG. 1. They also can be formed with at least part of the hollow keeper from a single piece of steel, e.g., 12–16 gauge, and optionally with the whole keeper, including the hollow wale portion, from a single steel piece that includes the hollow-channeled base.

While the cover support embodiments depicted are for circular holes, other shapes such as rectangles, triangles, squares, ovals, etc. are possible in accordance with invention principles, provided the cover supports are rendered adjustable as to their perimeter, usually with turnbuckle means.

It is especially important with polygonal (e.g., rectangular) manhole cover supports to have essentially horizontal turnbuckle bolts biased across the corners, and these bolts set inboard as much as is permissible, usually at least one inch, from the side of the cover support to which they directly deliver a component of their pressure.

The turnbuckle bolts biased at the corners can impart components of force that are axial to and perpendicular to the straight lateral segments of the cover support that they connect. For the particular bias of 45° relative to the longitudinal axes of the straight sides of a rectangular or square cover support, the magnitude of each such component is 0.707 times the bolt force. Positioning these bolts in the same plane as, but at virtually any other angle oblique to the corner it connects, i.e., biasing the bolt, is, of course, possible and practical in accordance with this invention. The perpendicular component of force holds the lateral side (segment) directly against the existing manhole frame. The axial component of force, being located inboard from the outer edge of the cover support, provides a bending moment on the lateral segment that actually increases the holding force between the periphery of the cover support and the existing manhole frame.

The conventional positioning of an expansion element such as a turnbuckle or spreading bolt somewhere along the longitudinal axis of the lateral segment, usually in the middle, exerts essentially only an axial force. Also a deleterious bending moment can be imparted to such bolt and segment. The bolt and its segment are apt to bow-up, down, or in towards the center of the manhole when especially heavily forced. Accordingly, it can be said that corner-spreading makes the bending moment on the bolt work for improved retention in the existing manhole cover frame (or other existing cover-receiving structure such as an existing cover support) instead of being useless or possibly even deleterious to the new cover support.

For a rectangular nominally 24"33 48" cover support the holding force has been calculated to be 26,600 pounds on each side, or a total of 106,400 pounds for the whole support. This compares quite favorably with that estimated for the same size cover support of the conventional (spread at the centers of the side lateral segments) design where both cover supports used the same kind of ½" turnbuckle bolts. In such conventional instance, the holding force was only 25,000 pounds on each side or 100,000 pounds for the whole support.

The holding forces for one side of a rectangular cover support with the corner spreaders can be calculated in accordance with the following formula "F", below, employing inch, pound and degrees of arc units:

$$Hc = \frac{4EA_tB_T1}{1_B}\,\mathrm{Cos}\theta + \frac{8 \cdot E \cdot A_t \cdot B_T \cdot 1 \cdot X}{1_B S} \cdot \mathrm{Sin}\theta, \text{ i.e.,} \qquad \text{Formula "F"}$$

where:

Hc = the holding force in pounds perpendicular to the manhole cover frame (but limited in magnitude by the yield strength of the bolt)

E 32 Young's modules of the bolt in pounds per square inch $A_t$ = tensile area of the bolt in square inches $B_T$ = the number of bolt turns after the cover support is seated 1 = the lead (inches) of the bolt threads 11B = the length of the exposed bolt in inches.

X = the perpendicular distance in inches from the contact periphery of the cover support to the center of the hole that is tapped therein for accepting the turnbuckle bolt S = the length of one side of the cover support in inches $\theta$ = the angle in degrees that longitudinal axis of turnbuckle bolt makes with the longitudinal axis of the side being held against the frame.

This equation, Formula F, can be simplified when the angle $\theta$ is 45° as it is in the embodiment shown in FIG. 1. The equation becomes:

Simplified Formula "F"

-continued $$Hc = \frac{2 \cdot 2 \cdot E \cdot A_tB_T1}{1_B}\left(1 + \frac{X}{S}\right), \text{ i.e.,}$$

Relative to the foregoing force considerations is the realization that the placing of the turnbuckle bolt is significant for developing lateral force, the force that is important for cover support retention in highway service. Thus, keeping the bolt hole opening (or the end pivot point of a turnbuckle having a screw protruding obliquely into a female-threaded end of a center turning member of a more common turnbuckle bolt) far inboard makes for a higher force value than putting it closer to the contact periphery of the cover support (which contacts and presses against the existing cover frame—or other existing manhole cover receiving structure). The inboard placement of any turnbuckle or like spreader mechanism, of course, permits longer threaded sections and allows for more peripheral adjustment. However, while many manhole covers have a reasonably flat top, they also can have a bottom that is reenforced by ribs, bracing, or like structure hanging down under; these cannot be interfered with, lest the cover won't seat in the newly-installed cover support. Accordingly, there can be a limit to the inboard placement of the spreader.

Advantageously, then, for developing improved retaining force and permitting substantial adjustment with such biased turnbuckle spreader means, the perpendicular distance from the contact periphery of the cover support to center point where the spreader means starts to shorten or lengthen should be at least about one inch and preferably is more, e.g., one and a half inches. Stated other ways, "X" in the above equations should be at least an inch or, as the force is being applied by the spreader to a zone near the end of a side segment, that zone can be treated as having a practical center point, and the perpendicular distance from that center point to the contact periphery of the straight-sided segment should be at least about an inch. The 45° angle biasing tends to develop about equal force in two directions, and this generally is desirable.

Modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. A manhole cover support having improved retainability in service and resistance to dislocation from vehicular traffic running over it, the cover support being adapted for emplacing over and raising the effective grade of an existing manhole cover receiving structure which has an upwardly-extending shoulder surface and a sill therebelow for accommodating a manhole cover, the cover support comprising:

a body that is adjustable in outer perimeter dimension and has a seat with a lateral keeper for a manhole cover and a base with an outer wall that is reactable against the shoulder surface of the receiving structure, the body being equipped with at least one spreader that provides a gap in the base and seat; and a flexible, compressible frictional retention component therefor that is interposable between the outer wall of the base and the shoulder surface of the receiving structure, said retention component comprising a resin-containing material, being not less than 8–9 mils nor more than about 400–600 mils thick, and having a coefficient of static friction with respect to said wall and said shoulder surface that substantially exceeds the coefficient of static friction obtainable directly between said wall and shoulder surface, said retention component being disposed to interact with an expansion of the body for substantially enhancing the grip between the body and the existing receiving structure.

2. The manhole cover support of claim 1 wherein the retention component is between about 20 and about 400 mils thick and has a coefficient of static friction to steel of at least about 0.4.

3. The manhole cover support of claim 1 wherein the retention component is bonded to and covers a substantial area of the outer wall of the base.

4. The manhole cover support of claim 1 wherein the retention component is in the form of a band or ring around the outer wall of the base.

5. The manhole cover support of claim 1 wherein the seat is integral with the base to form the upper surface thereof.

6. The manhole cover support of claim 1 which is adjustable in height by elevating means in the base.

7. The manhole cover support of claim 1 wherein the body is in the form of a split-ring that is adjustable in outer perimeter dimension.

8. The manhole cover support of claim 1 wherein the body is in the form of a plurality of joined segments adjustable in outer perimeter dimension, there being a joint between adjacent segments of the body; and each joint is equipped with a spreader.

9. The manhole cover support of claim 1 wherein the base and the seat constitute separable portions of the body, said base and seat being adapted to engage adjustably for fixing the elevation of the seat.

10. The manhole cover support of claim 9 wherein the seat has a skirt with an enlarged rim, the skirt extends downwardly into the base through a slot therein, and the rim is slidable into and is engaged with any one of a stack of like complementary cavity sets extending outwardly from the sides of the slot for permitting adjustment of the elevation of the seat.

11. The manhole cover support of claim 1 wherein the body and the receiving structure are substantially of ferrous metal, and the retention component has a coefficient of static friction to steel of at least about 0.4.

12. The manhole cover support of claim 1 wherein the retention component comprises a polymer.

13. The manhole cover support of claim 1 wherein the retention component comprises a foamed polymer and the component has Shore A durometer hardness between about 20 and about 70.

14. The manhole cover support of claim 1 wherein the retention component is elastomeric, and the component has Shore A durometer hardness between about 20 and 70.

15. The manhole cover support of claim 1 wherein the retention component comprises a cured plastisol.

16. The manhole cover support of claim 15 wherein the retention component comprises a heat-cured vinyl plastisol having Shore A durometer hardness between about 50 and 65.

17. The manhole cover support of claim 1 wherein the retention component comprises polyurethane.

18. The manhole cover support of claim 1 wherein the retention component comprises an epoxy resin.

19. The cover support of claim 1 wherein the top of the keeper is flanged outwardly.

20. The cover support of claim 1 wherein the body comprises at least one adjustable joint, and overlapping each adjustable joint is an extension of the keeper.

21. The cover support of claim 1 wherein outer perimeter adjustment is responsive to self-locking screw means.

22. A manhole cover support having improved retainability in service and resistance to dislocation from vehicular traffic running over it, the cover support being for emplacement over and raising the effective grade of an existing manhole cover receiving structure which has an upwardly extending shoulder surface and a sill therebelow for accommodating a manhole cover, the cover support comprising:

a body of ferrous metal that is adjustable in outer perimeter dimension and a flexible, compressible frictional natural or synthetic resin-containing retention component for the body, the body comprising a seat with a lateral keeper for the manhole cover, a base with an outer wall that is reactable against the shoulder surface of the receiving structure, and a spreader that provides a gap in the base and seat, the retention component being bonded to the outer wall of the base, being between about 20 and about 400 mils thick, and having a coefficient of static friction with respect to said wall and shoulder surface that exceeds the coefficient of friction obtainable directly between said wall and shoulder surface.

23. The manhole cover support of claim 1 wherein the seat also is covered with flexible, compressible natural or synthetic resin-containing material as a cushion for the cover.

24. The manhole cover support of claim 1 wherein the outside of the lateral keeper is at least partially covered with the retention component.

25. The manhole cover support of claim 1 wherein the thickness of the frictional retention component is between about a sixteenth and about an eighth of an inch.

26. In a process for retaining a manhole cover support in an existing receiving structure for a manhole cover wherein the receiving structure has an upwardly-extending shoulder surface and a sill therebelow, and the manhole cover support has a body that is adjustable in outer perimeter dimension and has a seat with a lateral keeper for a manhole cover and a base with an outer wall that is reactable against the shoulder surface of the receiving structure upon expansion of the body, the body being equipped with a spreader that provides a gap in the base and seat, the base being emplaced with its outer wall facing the upwardly-extending shoulder surface of the receiving structure, the improvement which comprises: interposing between said shoulder surface and outer wall area opposed thereto a flexible, compressible frictional retention component comprising a resin-containing material, being not less than 8–9 mils thick nor more than about 400–600 mils thick, and having a coefficient of static friction with respect to said wall and shoulder surfaces that substantially exceeds the coefficient of static friction obtainable directly between said surfaces; and expanding the body against the constraint of the receiving structure.

27. The process of claim 26 wherein the retention component is integral with the outer wall, is between about 20 and about 400 mils thick, and has a coefficient of static friction to steel of at least about 0.4.

28. The process of claim 27 wherein the retention component comprises a polymer.

29. The process of claim 28 wherein the retention component comprises a cured plastisol.

30. The process of claim 28 wherein the retention component comprises a thermoset elastomer.

* * * * *